US006705922B1

(12) United States Patent
Inbe

(10) Patent No.: US 6,705,922 B1
(45) Date of Patent: Mar. 16, 2004

(54) METHOD AND APPARATUS FOR POLISHING A SEMICONDUCTOR SUBSTRATE WAFER

(75) Inventor: Takashi Inbe, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 09/635,191

(22) Filed: Aug. 9, 2000

(30) Foreign Application Priority Data

Dec. 6, 1999 (JP) ..... 11-345814

(51) Int. Cl.[7] ..... B24B 49/12
(52) U.S. Cl. ..... 451/6; 451/41
(58) Field of Search ..... 451/6, 41, 296, 451/307, 59, 231, 233, 124

(56) References Cited

U.S. PATENT DOCUMENTS 5,569,063 A * 10/1996 Morioka et al. ..... 451/388
5,791,969 A * 8/1998 Lund ..... 451/296
5,938,504 A * 8/1999 Talieh ..... 451/11
5,967,881 A * 10/1999 Tucker ..... 451/41
6,221,774 B1 * 4/2001 Malik ..... 438/690

FOREIGN PATENT DOCUMENTS

JP 405096468 * 4/1993 ..... 451/165
JP 8-162432 6/1996

* cited by examiner

*Primary Examiner*—Robert A. Rose
(74) *Attorney, Agent, or Firm*—McDermott, Will & Emery

(57) ABSTRACT

A semiconductor substrate wafer 2 is supported on a wafer-supporting table 3 so that a surface to be polished is directed upward, a polishing roller 1 is bring to contact with the surface to be polished of the semiconductor substrate wafer 2, and the polishing roller is rolled over the wafer under a pressure whereby a scattering of polishing to the surface of the semiconductor substrate wafer can be eliminated while productivity is increased.

12 Claims, 7 Drawing Sheets

METHOD AND APPARATUS FOR POLISHING A SEMICONDUCTOR SUBSTRATE WAFER

BACKGROUND OF THE INVENTION

1. Field of the Invention

The present invention relates to manufacture of a emiconductor. In particular, the present invention relates to a method and an apparatus for polishing using a CMP (Chemical-Mechanical-Polishing) technique for flattening a structural surface of a semiconductor device.

2. Background Art

In manufacturing a semiconductor integrated circuit device, several manufacturing steps of forming a diffusion layer in a silicon substrate wafer, forming an electric conductive film, patterning the film, forming an insulating film and so on are repeatedly conducted to thereby form semiconductor elements in the silicon substrate wafer. As a demand of manufacturing a highly integrated semiconductor integrated circuit device is increased, there has arisen a large problem of steps (unevenness) produced in a surface of the wafer.

A semiconductor integrated circuit including semiconductor elements is prepared by forming various thin films on a silicon wafer and removing unnecessary portions of the thin films by utilizing an etching technique or the like. In such process, a resist pattern used as a mask for etching is mainly formed by a lithography technique with use of a reduction projection exposure system in which an i-line or a KrF-excimer laser is used. However, as the number of thin films to be laminated increases, the degree of a step formed in the wafer increases whereby the depth of focus of the reduction projection exposure system becomes insufficient. Therefore, it becomes difficult to form the resist pattern by the lithography technique.

As a technique to make a surface, on which a resist pattern is formed, flat, a CMP technique is noted wherein a surface of a wafer is polished to flatten it during the processing. As an example of a method utilizing the CMP technique, there is such a method that in order to flatten the surface of an insulating film or an electric conductive film formed on an uneven surface of a wafer produced in the previous proceeding, an abrasive material composed of, for example, a mixed liquid of colloidal silica and potassium hydroxide (herein-below, referred to as slurry) is used to remove unevenness in the wafer surface as the result of the simultaneous effects of mechanically polishing and a chemical function.

As an apparatus for CMP, such one as described with reference to FIG. 7 has been used. Namely, a circular disk-like polishing plate 12 provided with a polishing pad 11 at its upper surface is rotated in a horizontal plane. On the other hand, a wafer-supporting table 15 holding a wafer 16 thereon is rotated during which the surface to be polished of the wafer 16 is pressed to the polishing pad 11. While the polishing plate 12 is rotated with respect to the wafer-supporting table 15, slurry is dropped from a slurry supplying section 14 through a supplying port 13 onto the polishing pad 11 whereby polishing is conducted.

The purpose of flattening the wafer surface is to avoid a shortage in the depth of focus in a process of light exposure using a stepper wherein exposure is conducted through a mask pattern to form a resist pattern. In this process, a region subjected to exposure once is about 15 mm square to 20 mm square. Accordingly, in the exposure process, it is sufficient if a wafer surface area corresponding to only one-time exposure (one-shot exposure) is flat. In consideration of this, Japanese Unexamined Patent Publication JP-A-8-162432 proposes a method for using a polishing pad having a diameter of several mm—several cm to conduct a CMP polishing operation for flattening each region corresponding to one-shot exposure.

The conventional polishing apparatus having the above-mentioned structure has, however, the problem as follows.

When the CMP polishing operation is conducted using the polishing apparatus to a wafer and if the wafer is large in diameter, there causes uneven polishing due to a difference of momentum applied to the wafer between a central portion and a peripheral portion of the wafer; unevenness in a pushing force to the wafer; and a difference of quantity of slurry to be fed between the central portion and the peripheral portion of the wafer and so on. This may cause a difference in the thickness of layered thin films.

Further, when the CMP polishing is conducted for flattening, marks used for exposure are also flattened, whereby reduction in accuracy of reading the marks may result.

Further, in the polishing method disclosed in JP-A-8-162432, it is necessary to form a space between adjacent exposed regions as shown in FIG. 8 because a square region corresponding to one-shot exposure must be flattened thoroughly without exception to corner portions by using a circular disk-like polishing pad. Accordingly, the presence of spaces between exposed regions adjacent to each other will reduce the number of devices to be formed on the wafer, and an expected number of devices obtainable from a single wafer is decreased, thus, productivity will decrease.

SUMMARY OF THE INVENTION

It is an object of the present invention to provide a method for polishing a semiconductor substrate wafer wherein a scattering of polishing on the surface of a large-sized wafer can be eliminated while reduction in productivity is prevented.

It is another object of the present invention to provide an apparatus for polishing a semiconductor substrate wafer wherein a scattering of polishing on the surface of a large-sized wafer can be eliminated while reduction in productivity is prevented, and the supply of slurry can uniformly and easily be conducted.

In accordance with a first aspect of the present invention, there is provided a method for polishing a semiconductor substrate wafer which comprises forming an insulating film or an electric conductive film on a semiconductor substrate wafer having an uneven surface which is produced in the previous proceeding, rolling under a pressure a polishing roller on a surface to be polished on said wafer whereby the surface to be polished on the wafer is made flat.

According to a second aspect, there is provided the method according to the first aspect wherein the width in a longitudinal direction of the polishing roller is formed so as to correspond to the width of a one-shot exposure, and polishing is conducted for each region of one-shot exposure.

According to a third aspect, there is provided the method according to the first aspect wherein a space is formed between adjacent regions to be polished, and a mark is arranged in the space.

In accordance with a fourth aspect of the present invention, there is provided an apparatus for polishing a semiconductor substrate wafer which comprises a wafer supporting table on which a semiconductor substrate wafer is placed, a polishing roller for polishing the semiconductor wafer, a slurry supplying mechanism for supplying slurry between the semiconductor substrate wafer and the polishing roller and a pressurizing mechanism for pressing the polishing roller to the semiconductor wafer to bring the roller into contact with the wafer.

According to a fifth aspect, there is provided the apparatus according to the fourth aspect wherein the width in a longitudinal direction of the polishing roller is formed so as to correspond to the width of a region of one-shot exposure.

According to a sixth aspect, there is provided the apparatus according to the fourth aspect wherein slurry is supplied for each time when a region of one-shot exposure in the wafer having been subjected to photoengraving is polished.

According to a seventh aspect, there is provided the apparatus according to the fourth aspect, wherein there are means for measuring a region to be polished in the semiconductor substrate wafer according to "in-situ" observation and means for determining conditions of polishing on the polishing roller based on data obtained by measurements.

According to an eighth aspect, there is provided the apparatus according to the seventh aspect, a laser light is irradiated to a surface region to be polished of the semiconductor substrate wafer to measure a height of the surface of the semiconductor substrate wafer by utilizing interference of light.

According to a ninth aspect, there is provided the apparatus according to the seventh aspect, wherein light is irradiated to a surface region to be polished of the semiconductor substrate wafer to detect a change of the quality of an electric conducting film or an insulating film based on a change of an intensity or spectra of reflected light whereby the end point of polishing is determined.

According to a tenth aspect, there is provided the apparatus according to the fourth aspect, wherein a space is formed between adjacent regions to be polished, and a mark is arranged in the space.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

EMBODIMENT 1

Figure 1:
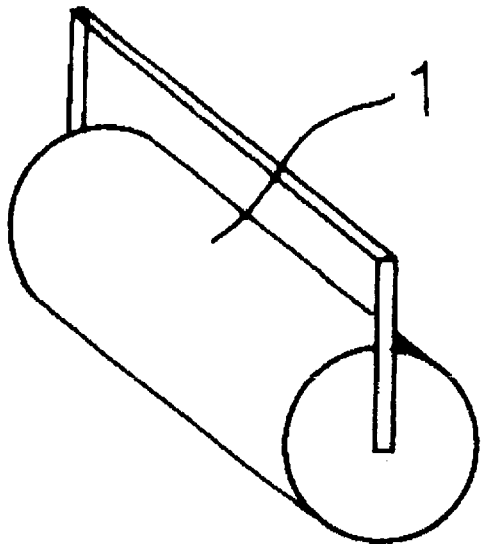
FIG. 1 is a diagrammatical perspective view of the polishing roller according to Embodiment 1 of the present invention.
Figure 2:
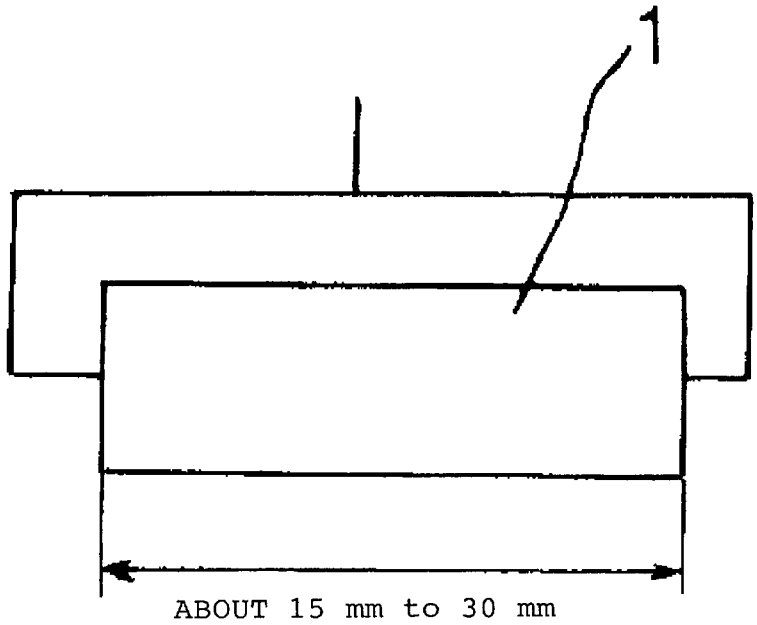
FIG. 2 is a diagrammatical front view of the polishing roller according to Embodiment 1 of the present invention.
Figure 3:
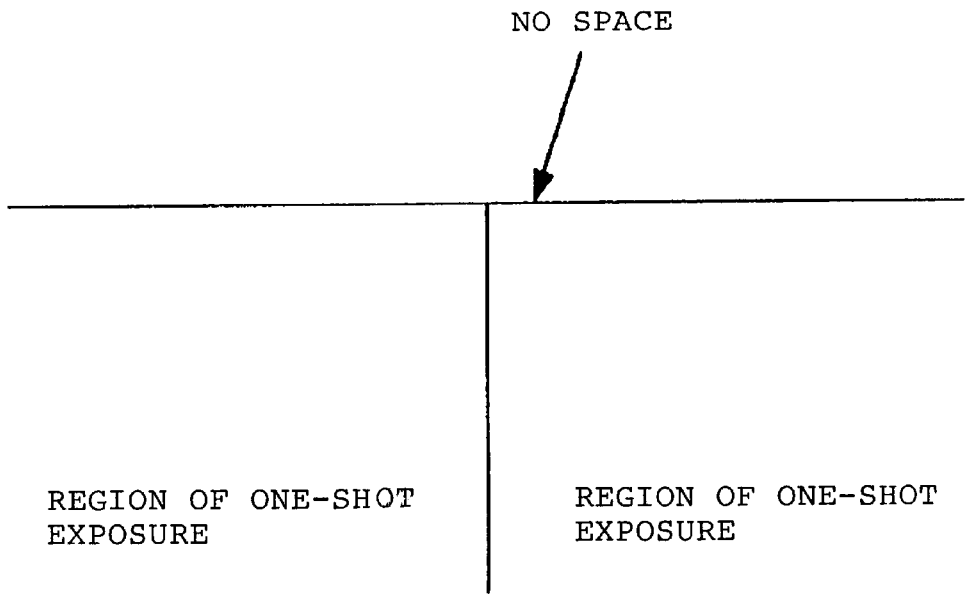
FIG. 3 is a diagram showing a surface of a wafer to which polishing is conducted.

Referring to FIGS. 1 and 2, a polishing roller 1 provided with a relatively hard polishing cloth is used unlike the conventional polishing roller having a circular disk-like shape. As a typical example of the relatively hard polishing cloth, there is IC-1000. It has physical values of a compressibility of 1.1%, an elastic recovery of 75%, a hardness of 95 (ASKER-C) etc. With use of such roller 1, polishing is carried out in the manner as shown in FIG. 3 whereby a scattering of polishing in a wafer surface having a large diameter can be eliminated, and there is little possibility of causing a reduction of productivity.

Further, by using the polishing roller 1, the supply of slurry can easily be conducted in a uniform manner in polishing a region corresponding to a one-shot exposure.

Figure 4:
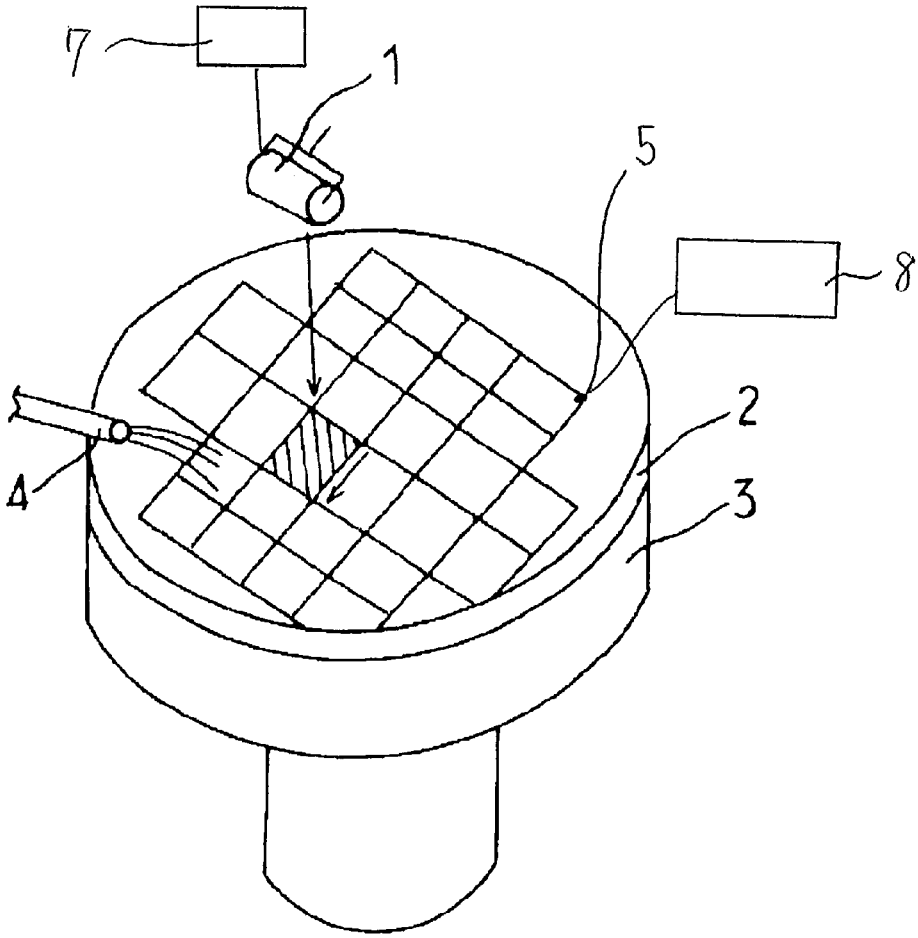
FIG. 4 is a perspective view of the polishing apparatus in Embodiment 1 of the present invention.

In FIG. 4 showing the polishing apparatus using the polishing roller 1, the polishing apparatus comprises a wafer supporting table 3 which supports a semiconductor wafer 2 in a horizontal direction so that the surface to be polished, of the wafer 2 is directed upward and the wafer is prohibited to rotate, the before-mentioned polishing roller 1 which has a cylindrical body in which the width in a longitudinal direction of the cylindrical body corresponds to the width of a region subjected to a one-shot exposure (a width of about 15 mm to 30 mm) (FIG. 2) and which is adapted to rotate around the axis of the cylindrical body to contact the semiconductor wafer 2, a slurry supplying mechanism 4 for supplying slurry between the surface of the semiconductor wafer 2 and the polishing roller 1 and pressing means 7 for pressing the polishing roller 1 to the semiconductor wafer 2 to contact the former with the later.

In operations, the rolling roller 1 is revolved in the arrow-marked direction in FIG. 4 so as to meet a region corresponding to the one-shot exposure, the region being formed by photoengraving, and is reciprocated several times, for example, to thereby perform polishing without relying on a pattern and at the same time, to improve uniformity of polishing of the surface of the semiconductor wafer 2. The slurry is supplied from an outer source for each polishing operation.

Figure 5:
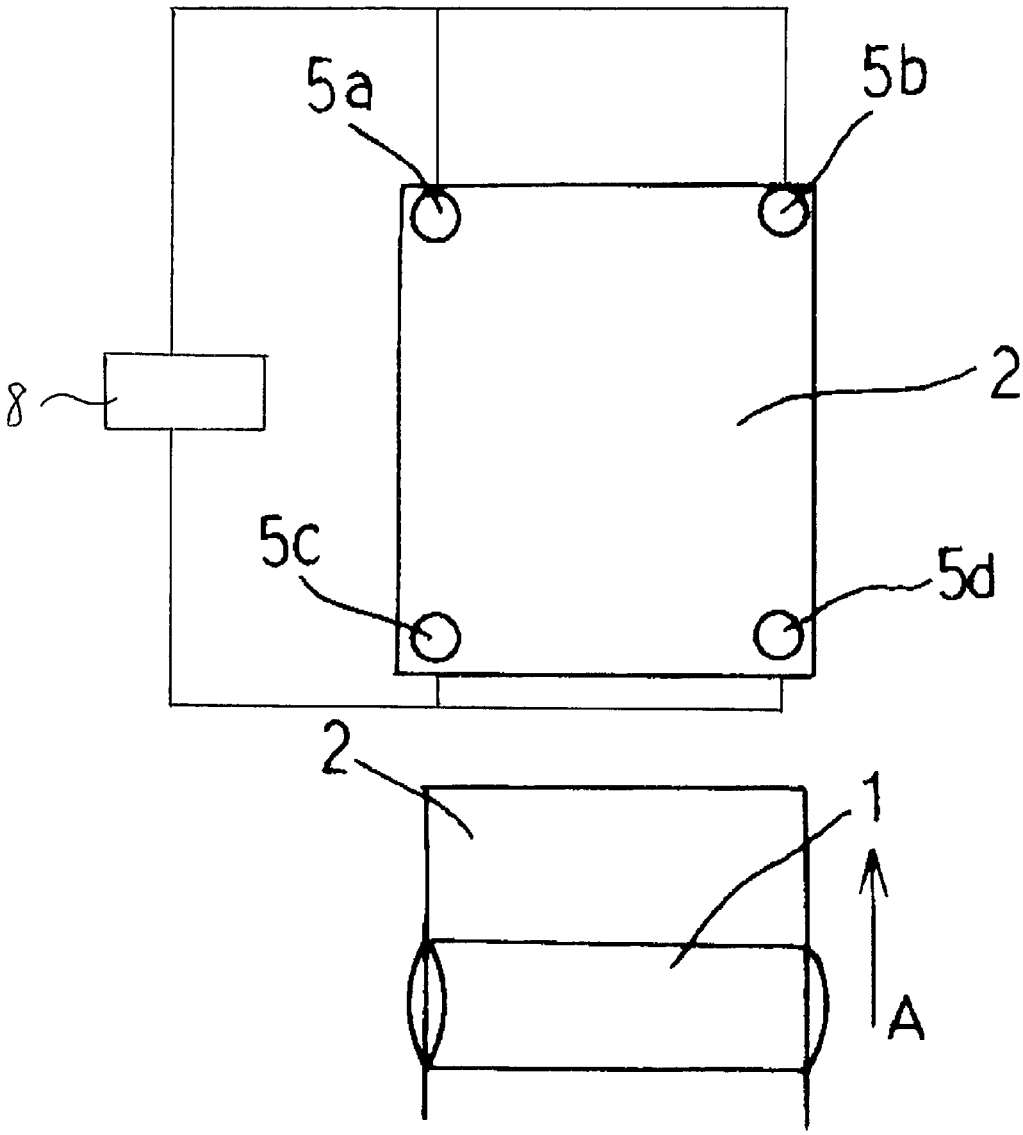
FIG. 5 is a diagram showing a region to be polished in a wafer.

A film thickness monitor or monitors 5*a*–5*d*, as means for measuring a region to be polished in the semiconductor substrate wafer according to "in-situ" observation, may be arranged, as shown in FIG. 5, to measure the thickness of the thin films so that the data obtained from the monitors are supplied to polishing condition determining means 8, whereby data produced in the determining means 8 are used for conditions for the polishing. In FIG. 5, an arrow mark indicates the direction of polishing.

EMBODIMENT 2

The polishing apparatus of the present invention may be provided with a measuring device for detecting or measuring a state of polishing or a degree of flatness of a region to be polished in the surface of the semiconductor wafer 2 according to "in-situ" observation. Obtainable data on the state of polishing or the degree of flatness may be automatically supplied through a computer to a control unit for controlling conditions of polishing, such as a revolution number, a pressure and so on, on the polishing roller.

Figure 9:
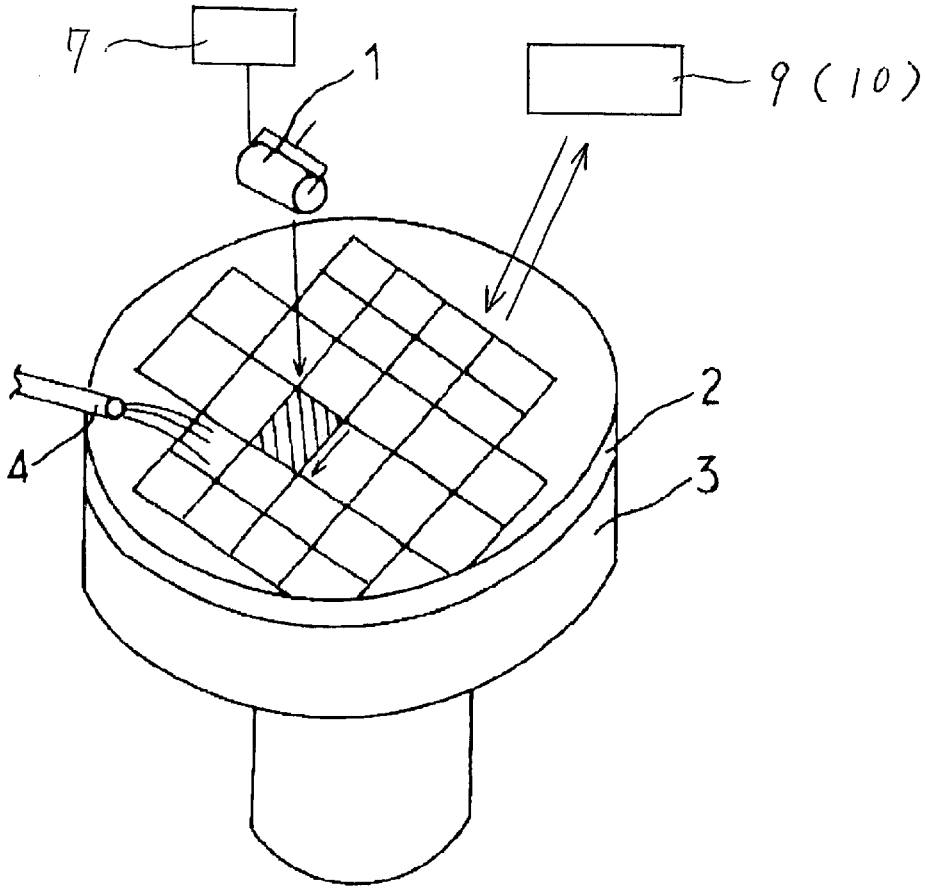
FIG. 9 is a perspective view of modified embodiment of the polishing apparatus shown in FIG. 4 of the present invention.

As an example of the measuring device, there is a device 9 as shown in FIG. 9 wherein laser is irradiated to a region to be polished in the surface of the semiconductor wafer 2 to detect a height of a surface portion of the wafer 2 by utilizing interference of light, whereby the state of polishing or the degree of flatness is measured.

As another example, there is a device 10 as shown in FIG. 9 wherein light is irradiated to a region to be polished in the surface of the semiconductor wafer 2 to detect a change of the quality of an electric conductive film or an insulating film to be polished based on a change of the intensity or spectra of reflected light, whereby the end point of polishing is detected.

EMBODIMENT 3

Figure 6:
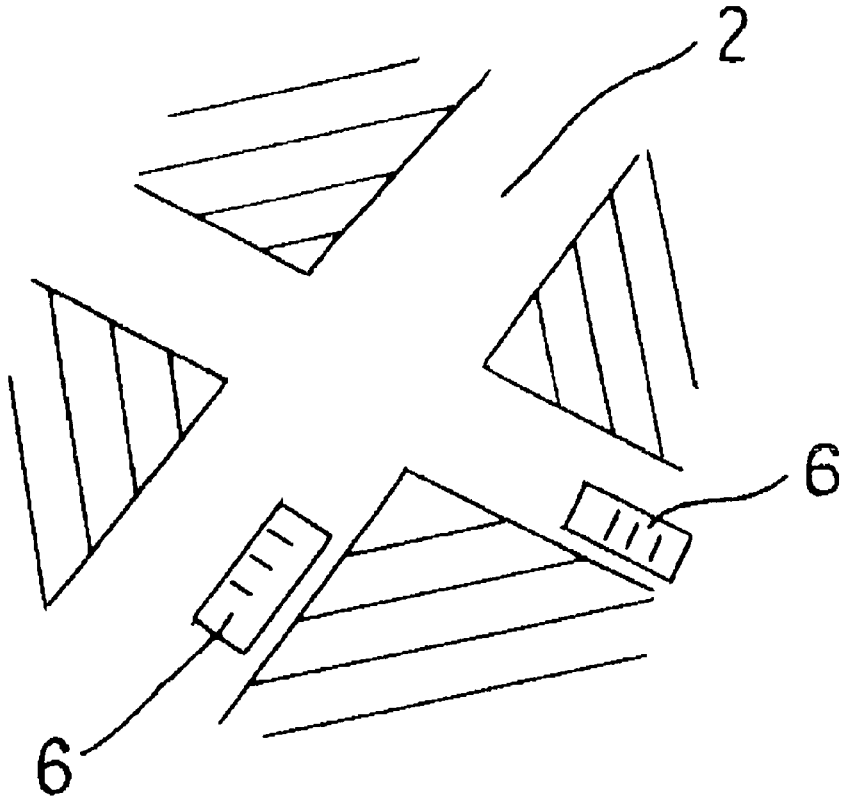
FIG. 6 is a plan view showing diagrammatically a wafer surface according to Embodiment 3 of the present invention.
Figure 7:
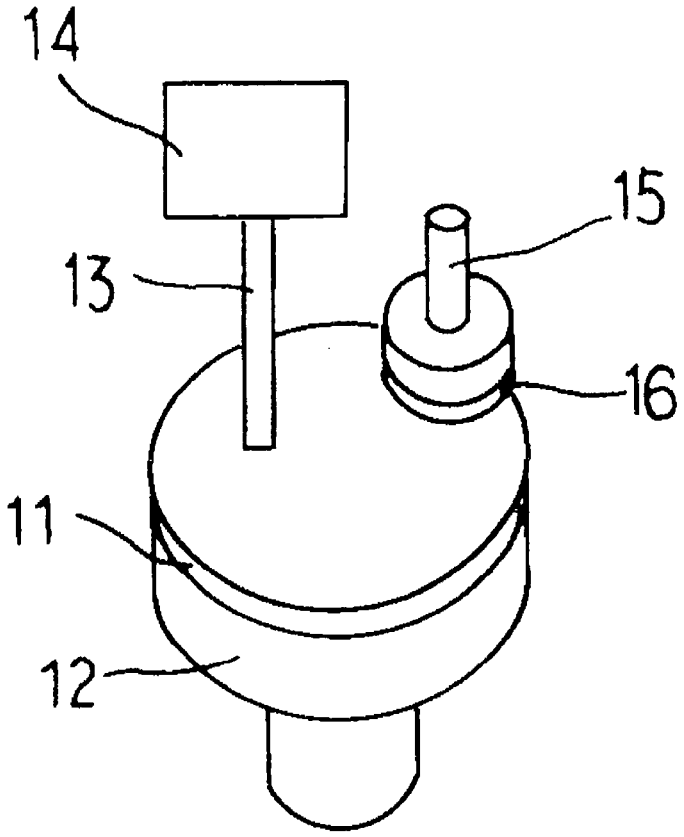
FIG. 7 PRIOR ART
FIG. 7 is a perspective view of a conventional polishing apparatus.
Figure 8:
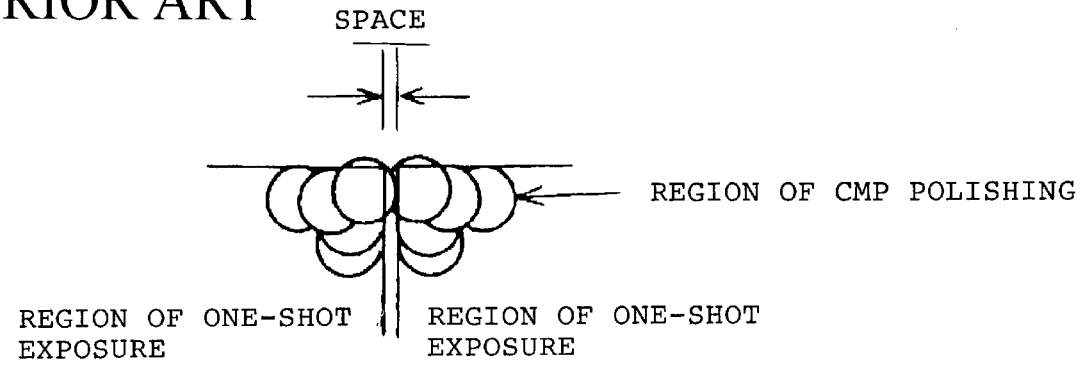
FIG. 8 PRIOR ART
FIG. 8 is a diagram showing a conventional polishing operation to a wafer surface.

As shown in FIG. 6, spaces can intentionally be formed between regions subjected to polishing so that marks 6 can be arranged in the spaces. In this case, the marks 6 can be excluded from the regions subjected to flattening by CMP with the result that the detection of the marks 6 can easily and correctly be carried out. Thus, the problem of the reduction of accuracy in detecting marks can be eliminated unlike the conventional CMP polishing process wherein the marks are flattened.

According to the first aspect of the present invention, the semiconductor substrate wafer can be polished without relying on a pattern, and uniformity of polishing can be improved as well as increasing productivity.

According to the second aspect, productivity can be improved and polishing can be performed uniformly.

According to the third aspect, the marks can be excluded from the regions subjected to flattening by CMP, and the detection of the marks can easily and correctly be carried out.

According to the fourth aspect, the reduction of productivity can be prevented while a scattering of polishing in the wafer surface is minimized.

According to the fifth aspect, uniformity of polishing in the surface of the semiconductor substrate wafer can be improved.

According to the sixth aspect, the supply of slurry can uniformly be carried out.

According to the seventh aspect, conditions such as a revolution number, a pressure and so on, on the polishing roller can automatically be determined, According to the eighth aspect, a scattering of polishing in the surface of the wafer can be eliminated.

According to the ninth aspect, a scattering of polishing in the surface of the wafer can be eliminated.

According to the tenth aspect, the marks can be excluded from the regions subjected to flattening by CMP, and the detection of the marks can easily and correctly be carried out.

Obviously, numerous modifications and variations of the present invention are possible in light of the above teachings. It is therefore to be understood that within the scope of the appended claims, the invention may be practiced otherwise than as specifically described therein.

The entire disclosure of Japanese Patent Application No. 11-345814 filed on Dec. 6, 1999 including specification, claims, drawings and summary are incorporated herein by reference in its entirety.

What is claimed is:

1. A method for polishing a semiconductor substrate wafer which comprises forming an insulating film or an electric conductive film on a semiconductor substrate wafer having an uneven surface, rolling under a pressure a polishing roller on a surface to be polished on said wafer while preventing rotation of said wafer, whereby the surface to be polished on the wafer is made flat, wherein the width in a longitudinal direction of the polishing roller is formed so as to correspond to the width of a one-shot exposure, and polishing is conducted for each region of one-shot exposure.

2. An apparatus for polishing a substrate, comprising:

a wafer support table adapted to hold a wafer thereon, said wafer including a surface having regions to be polished separated by spaces not to be polished, said spaces not to be polished include a mark adapted to be read; and a polishing roller including a polishing surface configured to polish only said regions to be polished so that marks in said spaces not to be polished can easily be read, wherein the width in a longitudinal direction of the polishing roller is formed so as to correspond to the width of a region of one-shot exposure.

3. The method for polishing a semiconductor substrate wafer according to claim 1, wherein a space is formed between adjacent regions to be polished, and a mark is arranged in the space.

4. An apparatus for polishing a semiconductor substrate wafer which comprises a wafer supporting table on which a semiconductor substrate wafer is placed, a polishing roller for polishing the semiconductor wafer, a slurry supplying mechanism for supplying slurry between the semiconductor substrate wafer and the polishing roller and a pressurizing mechanism for pressing the polishing roller to the semiconductor wafer to bring the roller into contact with the wafer, wherein said wafer supporting table is configured to prevent rotation of said wafer, wherein the width in a longitudinal direction of the polishing roller is formed so as to correspond to the width of a region of one-shot exposure.

5. A method for polishing a substrate, comprising:

placing a wafer on a wafer support table, said wafer including a surface having regions to be polished separated by spaces not to be polished, wherein said spaces not to be polished include a mark adapted to be read; and polishing, by way of a polishing roller, only said regions to be polished so that marks in said spaces not to be polished can easily be read, wherein the width in a longitudinal direction of the polishing roller is formed so as to correspond to the width of a one-shot exposure, and polishing is conducted for each region of one-shot exposure.

6. The apparatus for polishing a semiconductor substrate wafer according to claim 4, wherein slurry is supplied for each time when a region of one-shot exposure in the wafer having been subjected to photoengraving is polished.

7. The apparatus for polishing a semiconductor substrate wafer according to claim 4, which further comprises means for measuring a region to be polished in the semiconductor substrate wafer according to "in-situ" observation and means for determining conditions of polishing on the polishing roller based on data obtained by measurements.

8. The apparatus for polishing a semiconductor substrate wafer according to claim 7, wherein a laser light is irradiated to a surface region to be polished of the semiconductor substrate wafer to measure a height of the surface of the semiconductor substrate wafer by utilizing interference of light.

9. The apparatus for polishing a semiconductor substrate wafer according to claim 7, wherein light is irradiated to a surface region to be polished of the semiconductor substrate wafer to detect a change of the quality of an electric conducting film or an insulating film based on a change of an intensity or spectra of reflected light whereby the end point of polishing is determined.

10. The apparatus for polishing a semiconductor substrate wafer according to claim 4, wherein a space is formed between adjacent regions to be polished, and a mark is arranged in the space.

11. An apparatus for polishing a substrate, comprising:

a wafer support table adapted to hold a wafer thereon; and a polishing roller having a polishing surface for polishing a wafer surface, said polishing surface being configured to move in a closed-loop path, wherein the width in a longitudinal direction of the polishing roller is formed so as to correspond to the width of a region of one-shot exposure.

12. The apparatus for polishing a substrate of claim 11, wherein said polishing surface forms a closed-loop.

* * * * *